US009084065B2

(12) United States Patent
Hasler et al.

(10) Patent No.: US 9,084,065 B2
(45) Date of Patent: Jul. 14, 2015

(54) HEARING SYSTEM AND METHOD FOR OPERATING THE SAME

(75) Inventors: Ivo Hasler, Winterthur (CH); Lukas Erni, Zürich (CH); Micha Knaus, Jona (CH)

(73) Assignee: PHONAK AG, Stafa (CH)

( * ) Notice: Subject to any disclaimer, the term of this patent is extended or adjusted under 35 U.S.C. 154(b) by 1222 days.

(21) Appl. No.: 12/668,088

(22) PCT Filed: Jul. 11, 2007

(86) PCT No.: PCT/EP2007/057110

§ 371 (c)(1),
(2), (4) Date: Apr. 20, 2010

(87) PCT Pub. No.: WO2007/116103

PCT Pub. Date: Oct. 18, 2007

(65) Prior Publication Data

US 2011/0129106 A1 Jun. 2, 2011

(51) Int. Cl.
*H04R 25/00* (2006.01)

(52) U.S. Cl.
CPC ..... *H04R 25/558* (2013.01); *H04R 25/50* (2013.01); *H04R 25/552* (2013.01); *H04R 25/505* (2013.01); *H04R 2225/55* (2013.01)

(58) Field of Classification Search
CPC ..... H04R 2225/55; H04R 25/505; H04R 25/558; H04R 25/552; H04R 25/554; H04R 25/50; H04R 25/70
USPC ..... 381/58, 60, 312, 314, 315, 323; 455/418, 419, 420, 557, 556.1; 600/559; 607/56, 57
See application file for complete search history.

(56) References Cited

U.S. PATENT DOCUMENTS

| | | | | |
|---|---|---|---|---|
| 6,850,775 | B1 * | 2/2005 | Berg | 455/556.1 |
| 2007/0071264 | A1 | 3/2007 | Baechler et al. | |
| 2010/0142737 | A1 * | 6/2010 | Roeck et al. | 381/315 |

FOREIGN PATENT DOCUMENTS

| | | | |
|---|---|---|---|
| DE | 10048338 | A1 | 4/2002 |
| EP | 1720378 | A1 | 11/2006 |

OTHER PUBLICATIONS

International Search Report for PCT/EP2007/057110 dated Jun. 24, 2008.
Written Opinion for PCT/EP2007/057110 dated Jun. 24, 2008.

*Primary Examiner* — Huyen D Le
(74) *Attorney, Agent, or Firm* — Pearne & Gordon LLP

(57) ABSTRACT

The method for operating a hearing system comprises the steps of
a) requesting (300) said hearing system to execute a functionality; and
b) deciding (400) whether or not to execute the requested functionality.
It preferably comprises the steps of
c) checking (440) the current availability of the requested functionality;
wherein the decision of step b) depends on the so-obtained current availability of the requested functionality, and
d) executing the requested functionality, only if the requested functionality is currently available in said hearing system.
The hearing system comprises at least one decision unit adapted to deciding whether or not to execute functionalities the hearing system is requested to execute.
The invention can make it possible to form hearing systems from a wide range of devices.

15 Claims, 2 Drawing Sheets

HEARING SYSTEM AND METHOD FOR OPERATING THE SAME

TECHNICAL FIELD

The invention relates to a hearing system and to a method for operating a hearing system. More particularly, the invention relates to the execution of functionalities of a hearing system.

For the purpose of the present patent application, a hearing system comprises at least two devices, at least one of which is a hearing device. All devices of the hearing system are operationally interconnectable within the hearing system by short-range communication links, typically wireless links. Typical devices of a hearing system are hearing devices, remote controls, remote microphones. Typically, devices of hearing systems are meant to be worn or carried by said individual.

Under a hearing device, a device is understood, which is worn in or adjacent to an individual's ear with the object to improve the individual's acoustical perception. Such improvement may also be barring acoustic signals from being perceived in the sense of hearing protection for the individual. If the hearing device is tailored so as to improve the perception of a hearing impaired individual towards hearing perception of a "standard" individual, then we speak of a hearing-aid device. A hearing system comprising at least one hearing-aid device is referred to as hearing-aid system. With respect to the application area, a hearing device may be applied behind the ear, in the ear, completely in the ear canal or may be implanted.

BACKGROUND OF THE INVENTION

It is known to sell hearing systems as a set of two or more devices, which are specifically tailored so as to be compatible and adapted to each other. If another device shall be added to the hearing system, that other device has to be such a specifically tailored device, too. This way, it is ensured that the hearing system as a whole functions correctly.

If hearing systems with different ranges of functionalities, e.g., basic hearing systems which offer only basic functionalities, advanced hearing systems which offer additional functionalities and high-end hearing systems which offer very many and very elaborate functionalities, shall be offered, it will usually be necessary to offer three distinct sets of devices: a first set of devices, which can be used in said basic hearing systems (and—at least in part—not usable in advanced or high-end hearing systems), a second set of devices, which can be used in said advanced hearing systems (and—at least in part—not usable in basic or high-end hearing systems), and a third set of devices, which can be used in said high-end hearing systems (and—at least in part—not usable in basic or advanced hearing systems). From an economical point of view and with respect to handling and logistics of the devices, this is not desirable.

It is desirable to find ways to provide devices which are usable in an increased number of hearing systems.

SUMMARY OF THE INVENTION

Therefore, one object of the invention is to create a hearing system that does not have the disadvantages mentioned above. In addition, the respective method for operating a hearing system shall be provided.

Another object of the invention is to provide a hearing system which is compatible with a wide range of hearing devices.

Another object of the invention is to provide a way to establish compatibility between devices, so as to enable the joint use of said devices in common hearing system.

Another object of the invention is to enable the formation of hearing systems from a wide range of devices.

Further objects emerge from the description and embodiments below.

At least one of these objects is at least partially achieved by apparatuses and methods according to the patent claims.

The inventors found that one important point for the compatibility of devices in a hearing system is the availability of functionalities. E.g., it is undesirable to let a hearing system user select a certain functionality such as a beam former, if the devices of the hearing system are not capable of providing the selected functionality, e.g., due to lack of suitable beam former processing algorithms or due to lack of required hardware such as spaced-apart microphones. An attempt of such a selection should at least cause that the user is informed that the selected functionality is not available.

The method for operating a hearing system comprises the steps of a) requesting said hearing system to execute a functionality; and b) deciding whether or not to execute the requested functionality.

The hearing system comprises at least one decision unit adapted to deciding whether or not to execute functionalities the hearing system is requested to execute.

Through this, a control mechanism is established, which can prevent the attempt to execute an unexecutable functionality and/or which can provide a user of the hearing system with information about the availability or unavailability of said requested functionality. Thus, it is not necessary to preprogram all devices of a hearing system with information indicative of all the functionalities that are available within the hearing system. This allows to put less strict restrictions on devices that can (safely) be added to a hearing system. The addition of devices to a hearing system is facilitated.

Said requested functionality usually is a functionality to be executed within the hearing system. Said decision is made within said hearing system.

The devices of said hearing system can be considered to form a communication network, more particularly a short-range communication network, e.g., using the well-known Bluetooth standard.

In one embodiment, said hearing system is a hearing-aid system.

In one embodiment, step b) is carried out by said hearing system automatically upon step a). Step b) can be considered to form part of a communication protocol, which is carried out whenever the execution of a functionality is requested in the hearing system.

In one embodiment, step a) is accomplished by operating at least one user control of at least one device of said hearing system. Step a) is typically carried out by the user of the hearing system. E.g., the user toggles a program switch or pushes a volume-up button.

In one embodiment, step b) comprises the step of c) checking the current availability of the requested functionality;

wherein the decision of step b) depends on the so-obtained current availability of the requested functionality.

The term "current availability" is used in order to make clear that there might not be only features which are generally available or unavailable, but also features that are temporally available or unavailable, such as functionalities, which use resources that can also be used by other functionalities of the hearing system, so that they might be blocked by such an other functionality, if a simultaneous use of such shared resources is not possible.

In one embodiment, the method comprises the step of d) executing the requested functionality, only if the requested functionality is currently available in said hearing system.

If the requested functionality is not currently available in said hearing system, it will not be executed.

In one embodiment, the method comprises the step of e) executing an alert or error function, if the requested functionality is not currently available in said hearing system.

That means, e.g., if a user requests a (currently) unavailable functionality, he will be informed that the requested functionality is not executed. If the user would not be informed, he might request said functionality over and over again, while no change occurs and the user might assume that there is a defect in the hearing system.

Said alert or error function may, e.g., simply cause the generation of a beep, or said alert or error function may, e.g., just suggest an alternative functionality, which is similar to the requested functionality, but currently available in said hearing system In one embodiment, step c) comprises the step of f) obtaining data related to the provision of at least one resource in said hearing system;

wherein the decision of step b) depends on whether or not said at least one resource is provided in said hearing system.

Such resources can, e.g., be hardware such as a microphone or a wireless transmitter or a processor, or software such as pieces of code or implementations of algorithms.

This can allow to check the general availability of a functionality, since a functionality is embodied using resources such as software and hardware.

E.g., it is possible to (request and) obtain such data from one or more or all devices of the hearing system, or, more selectively, to (request and) obtain such data only from devices that are possibly relevant for the current availability of the requested functionality. And, it is, e.g., possible to (request and) obtain such data for one or more or all resources in the hearing system, or, more selectively, to (request and) obtain such data only for resources that are possibly relevant for the requested functionality.

Step f) can comprise the step of checking compatibilities. For example, if, for a requested functionality, a version 2.3 or higher of a noise-cancelling algorithm is required, but solely version 1.8 of said noise-cancelling algorithm is available in the hearing system, the requested service (execution of the requested functionality) will not be granted, since a required resource is (generally) unavailable in the hearing system.

In one embodiment, step c) comprises the step of g) obtaining data related to the status of said hearing system;

wherein the decision of step b) depends on said status.

This allows to examine the status of the hearing system, and more particularly the status of resources of the hearing system. E.g., it is possible to (request and) obtain such data in a rather complete manner, or, more selectively, to (request and) obtain such data only inasfar as it is relevant for the current availability of the requested functionality.

For example, data can be (requested and) obtained, which are indicative of at least one functionality of said hearing system which is currently executed in said hearing system, e.g., a list of all currently executed functionalities. Or, for one or more functionalities, data can be (requested and) obtained, which are indicative of the status of the respective functionality.

In one embodiment, step c) comprises the step of h) obtaining data representative of at least one rule related to at least one functionality provided in said hearing system;

wherein the decision of step b) depends on compliance with said at least one rule.

More specifically, said at least one rule can be related to said requested functionality.

Usually, the requested functionality will be executed only of the hearing system is currently in compliance with said at least one rule.

One example for such rules are rules related to priority. E.g., if a first service is requested and it is detected that a certain resource (which is needed for said first functionality and which is only once available within the hearing system) is currently used by a second functionality, it has to be decided whether said second functionality shall be terminated in order to free said resource and make it available for said first service, or whether said first service shall be considered unavailable, since said resource is currently unavailable. This is a matter of priority rules: If said first functionality is (under the given conditions) considered more important (higher priority) than said second functionality, it shall be executed; if it is considered less important (lower priority), said second functionality will be able to continue, and the execution of said first functionality will be denied, preferably involving providing the user with corresponding information.

Rules can, e.g., consider the status of the hearing system and/or the current acoustic environment and implement that a requested functionality will not be executed if this is considered disadvantageous or futile. E.g., if the currently used audio stream (which is finally lead to an audible signal for the hearing system user) is collected from a telephone using a telephone coil of the hearing system, the request for using a beam former does not make sense and will therefore be denied.

Typically, the data mentioned in step f) and/or step g) and/or step h) are requested in order to be obtained, typically requested by one device from one or more or all devices of the hearing system. Said requesting of data and said obtaining the data, respectively, is typically carried out automatically after a functionality is requested, i.e. after step a).

In one embodiment, step c) comprises the step of i) transmitting data from at least one device of said hearing system to at least one other device of said hearing system.

Said transmitted data are usually data used in making the decision of step b). In particular, at least the information mentioned in at least one of steps f), g), h) will typically be transmitted.

In one embodiment, said current availability is independent of the identity of the individual using said hearing system and/or of who carries out step a).

In one embodiment, the decision of step b) is independent of which individual is user of said hearing system and/or of who carries out step a).

Typically, communication within the method according to the invention is confined to communication within the hearing system and/or confined to short-range communication.

In one embodiment, the method comprises the step of r) repeating step b) during carrying out the requested functionality.

This allows to terminate the execution of the requested functionality upon certain events, typically based on rules, such as the rules mentioned in step h). E.g., if a strongly energy-consuming functionality has been requested and is carried out, and after some time, the corresponding energy supply of the hearing system becomes weak, it is possible to terminate said strongly energy-consuming functionality in order to be able to provide functionalities, which need less energy and are more vital to the hearing system, with energy for longer time. Preferably, the user will be informed about this, maybe including a possibility to choose whether or not to terminate said strongly energy-consuming functionality.

Considered under a slightly different point of view, the invention concerns the granting of services in a hearing system. Therein, said services largely correspond to the above-mentioned functionalities or to their execution, and said granting largely corresponds to the decision whether or not to execute a service/functionality.

Considered under another slightly different point of view, the invention concerns the execution of commands in a hearing system and/or a protocol to be carried out when the execution of a command is requested in a hearing system. There are apparatuses (hearing systems), which correspond to methods, and the advantages of the apparatuses correspond to the advantages of corresponding methods.

Further preferred embodiments and advantages emerge from the dependent claims and the figures.

BRIEF DESCRIPTION OF THE DRAWINGS

Below, the invention is described in more detail by means of examples and the included drawings. The figures show.

The reference symbols used in the figures and their meaning are summarized in the list of reference symbols. The described embodiments are meant as examples and shall not confine the invention.

DETAILED DESCRIPTION OF THE INVENTION

Figure 1:
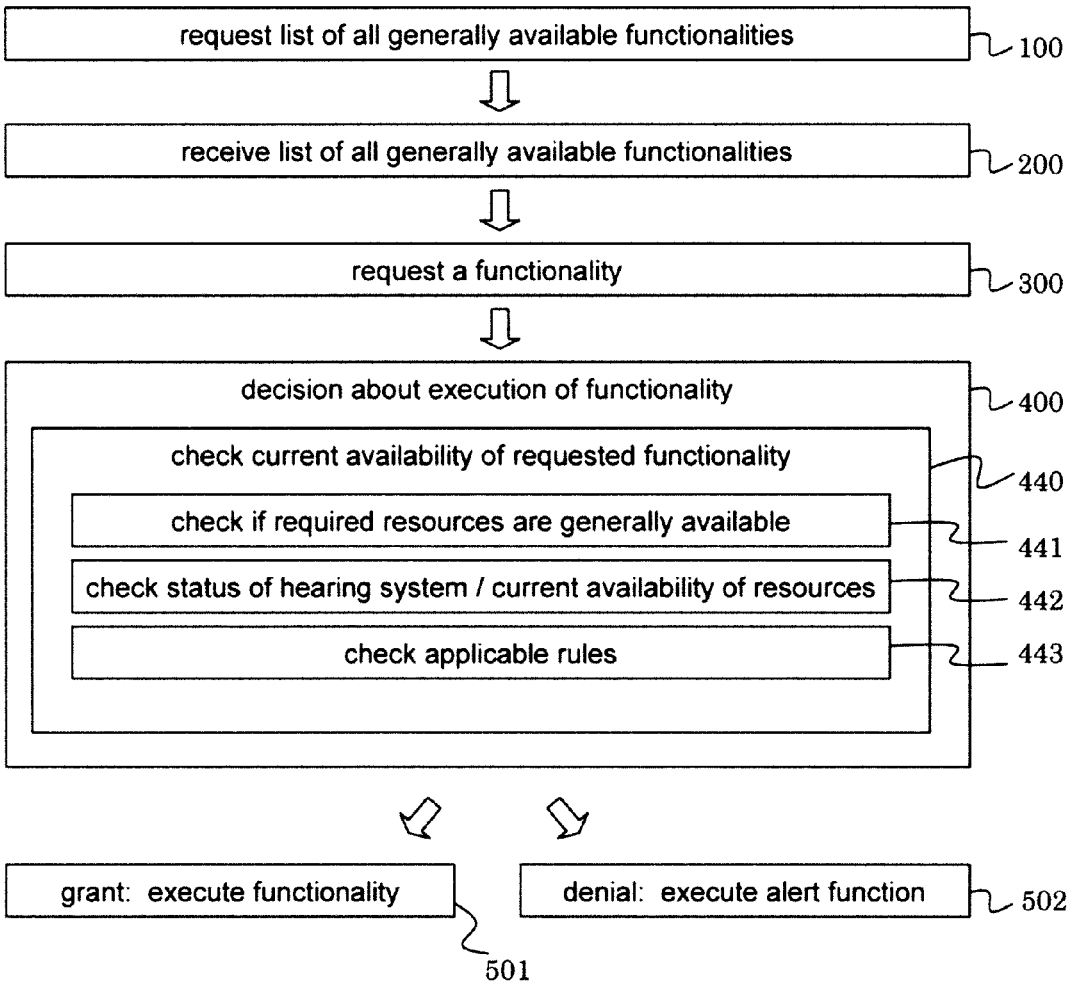
FIG. 1 a block diagram illustrating a method according to the invention.

FIG. 1 shows a block diagram illustrating a method according to the invention. Steps 100 and 200 are optional. In step 100, a list of all generally available functionalities is requested from a device of a hearing system or from the whole hearing system, i.e., from each devices of said hearing system. In step 200, said list is received.

In step 300, a functionality of the hearing system is requested, e.g., the user of the hearing system has operated a user control of a device of the hearing system. The user may have requested, e.g.,

- a change in output volume of hearing devices of the hearing system,
- a change of the applied hearing program,
- the use of a beam former or of a noise canceller or of a feedback canceller,
- to switch from microphones as input converters to a telephone coil,
- to display a list of functionalities providable by the hearing system,
- to stream stereo audio signals from an accessory of the hearing system to two hearing devices of the hearing system, or another functionality of the hearing system.

If steps 100 and 200 have been carried out, step 441 (see below) can be omitted, since the range of functionalities from which the functionality requested in step 300 can meaningfully be selected, can be reduced by selecting from said list only.

In step 400, it is decided about the execution of the requested functionality. For obtaining a basis for this decision, it is checked in step 440, whether or not the requested functionality is currently available.

This checking includes at least one of steps 441, 442 and 443.

In step 441, it is checked whether the requested functionality is generally available in the hearing system, e.g., whether required software is installed and whether required hardware is provided in the hearing system. If steps 100 and 200 are carried out sufficiently often, e.g., in reasonable time intervals, or if steps 100 and 200 are automatically carried out upon step 300, step 441 can be omitted.

In step 442, the status of the hearing system is checked, e.g., it can be checked which hearing program is currently selected and/or which functionalities are currently in use. In particular, it can be checked whether all resources required for executing the requested functionality are currently available. It could, e.g., be that a resource, be it processing power, transmission bandwidth, a piece of hardware or others is currently unavailable, because it is currently used (executed) by another functionality.

In step 443, applicable rules are checked. Such rules shall be complied with in the decision of step 400. One rule might be, e.g., "the use a beam former while hearing program 3 is used is not allowed, since it does not make sense". And an attempt to do so shall therefore be answered by an alert signal.

If, in steps 400,440, it is decided that the requested functionality is currently available, it will be executed (grant of service, step 501). If, however, it is decided in steps 400,440 that the requested functionality is currently unavailable, it will not be executed, and the user will be informed by a warning, and error or an alert function (step 502).

Putting hearing devices and a remote control according to the state of the art together, so as to try to form hearing system, it might happen, e.g., that said remote control of the hearing system has a button for selecting hearing program 7, whereas the hearing devices can only handle four hearing programs. Pressing said button will quite surely neither select a suitable hearing program, nor cause the generation of an alert message indicating that the selected functionality (selecting hearing program 7) will not be carried out, since hearing program 7 is generally not available. Today, the devices of hearing systems work such, that they simply must assume that any functionality that can be requested is also executable in the hearing system and will therefore be carried out when it is requested.

By means of the invention, the selecting of functionalities is made safer, and the range of devices that can properly work together in hearing systems is greatly enlarged.

Figure 2:
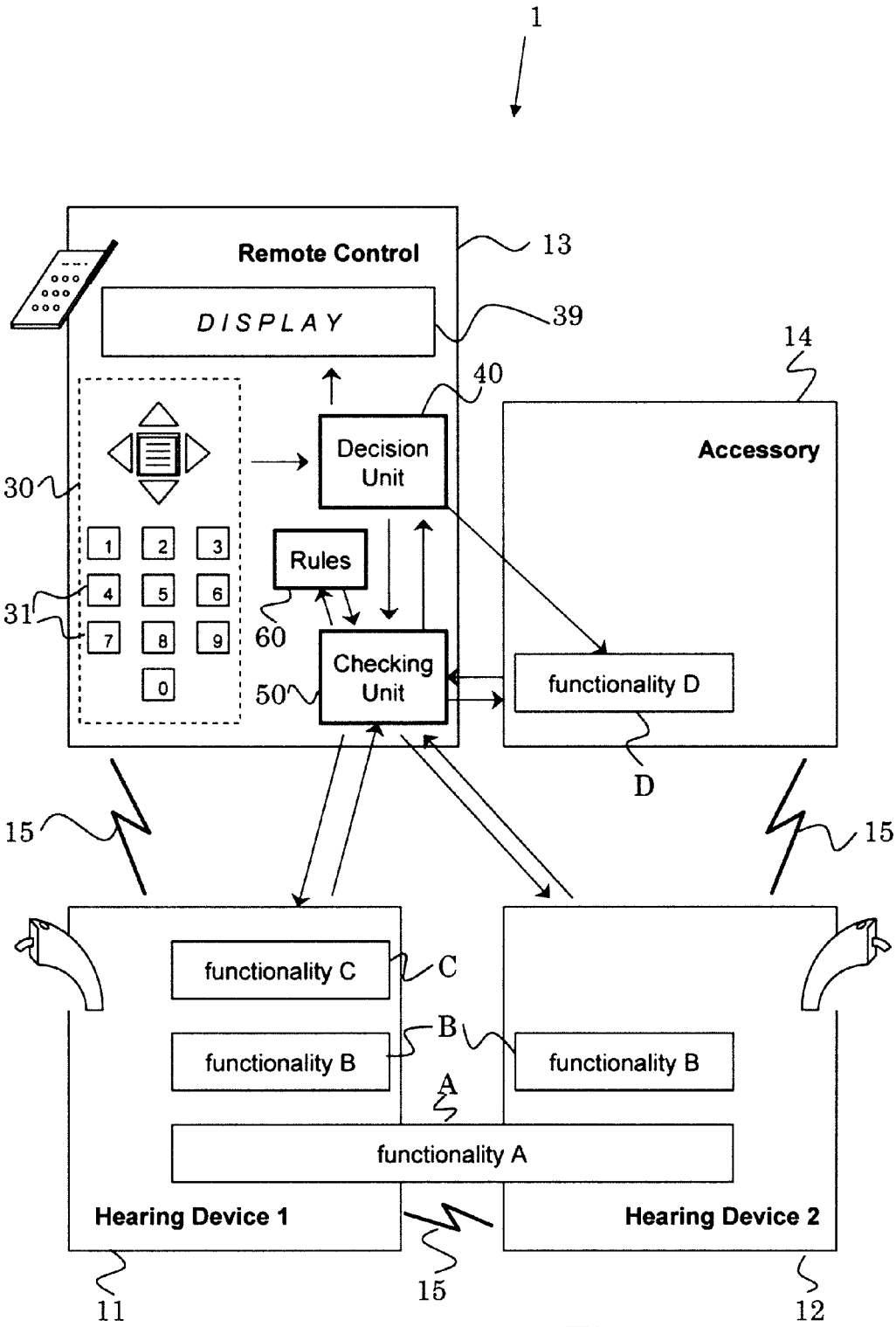
FIG. 2 a schematic illustration of a hearing system and a method according to the invention.

FIG. 2 is a schematic illustration of a hearing system 1 and a method according to the invention. Hearing system 1 comprises two hearing devices 11,12, a remote control 13 and another (accessory) device 14, which are operationally interconnected (directly or indirectly) by wireless links 15, e.g., inductive links, and form a short-range communication network. Transmission and receiving units of said communication network are not shown in FIG. 2.

The hearing system 1 comprises a decision unit 40, a checking unit 50 and a storage unit 60, which are, in FIG. 2, comprised in remote control 13. In general, units 40, 50 and 60 can be comprised in any device 11,12,13,14 of the hearing system 1, and they can also be distributed among two or more devices of the hearing system 1. And each one of said units can be distributed among two or more devices of the hearing system 1.

Hearing device 11 provides, together with hearing device 12, a functionality A, e.g., a beam former functionality. A functionality B is provided by hearing device 1 as well as by hearing device 12. A functionality C is provided solely by hearing device C, and a functionality D is provided solely by device 14.

Remote control 13 comprises a user input interface 30, embodied as several user controls 31 such as buttons and switches, and a user output interface 39, embodied as a display 39. A user output interface could, alternatively or additionally, comprise an acoustic output unit such as a loudspeaker, e.g., a receiver of hearing device 11 and/or hearing device 12.

When a user of hearing system 1 requests from hearing system 1 the execution of a functionality, e.g., by pressing a button 31 of user control 30 of remote control 13, this functionality will not be executed immediately, as it would be the case in a hearing system according to the state of the art. Instead, it will before be decided by decision unit 40, whether or not the requested functionality will be executed. This will typically depend mainly on the current availability of the requested functionality. In order to check said current availability, decision unit 40 is operationally connected to checking unit 50, which again is operationally connected to the other devices 11,12,14 of the hearing system 1.

Let's assume that the user requested functionality D. In that case, checking unit 50 will be informed that the requested functionality (D) is—generally—available in device 14 (and not available in another device of the hearing system). If it is furthermore informed that functionality D is currently not blocked or occupied, decision unit 40 can be informed of these findings. Decision unit 40 will thereupon allow the execution of functionality D as requested. Of course, checking unit 40 can also check whether or not functionality D is available in remote control 13. A storage unit in which data received by checking unit 50 are stored, is not drawn in FIG. 21.

It is possible that several rules, as stored in storage unit 60, have to be considered in order to determine whether or not the requested functionality shall be executed. Accordingly, storage unit 60 is operationally connected to decision unit 40 and to checking unit 60. Such rules can, e.g., prioritize functionalities or ensure that auditory and/or technical circumstances, limits and given facts are considered. E.g., some functionalities may be denied if an energy supply of the hearing system 1 is low, or some functionalities are denied when certain hearing programs are currently selected, or the like.

In another example, if the user had selected a functionality E, which is not provided in hearing system 1, e.g., because a corresponding piece of software is not installed or because some piece of hardware is not provided, decision unit 40 will provide the user with an alert or a warning, such as displaying in display 39 a text like "this function is not available" or by generating an acoustic alert.

It is also possible that at the time a certain functionality has been requested, said functionality has been available; but while said functionality is executed, the status of hearing system 1 changes such that said functionality should be terminated, e.g., because a resource of hearing system 1 used by said functionality shall be used by another functionality which is considered to have a higher priority than said requested functionality. If checking unit 50 and decision unit 40 repeatedly check the status of hearing system 1 and, accordingly, repeatedly decide whether or not a once-requested functionality shall continue to be carried out, such situations can be handled properly.

The term "availability" or "current availability" as described above ("is a functionality—generally—provided/implemented/existing in the hearing system?"; "is it free to be used now, or blocked/occupied?"; "is its execution compliant with applicable rules?") describes a technical availability/current technical availability, which is related to the hearing system and its status. For example, it does not matter which individual requests a certain functionality.

The rules described above are merely technical rules, determined, e.g., by properties and status of hardware and software of the hearing system, by what the hearing system finds out about the current acoustic environment (e.g., by classification), and by audiologic knowledge or findings. It is possible, in a particular embodiment, to provide additional rules, which are not of technical nature, but of economic nature, in the sense that certain functionalities are made available in the hearing system (although being technically available) only if they are cleared by a hearing system professional such as a hearing system seller or audiologist, or by the hearing system manufacturer, typically against a payment.

An example for such a non-technical rule might be that a user has bought a low-price hearing system, which only offers basic features. But practically the same hearing system is available as an advanced hearing system, which differs from said low-price hearing system only in that several functionalities are unblocked (cleared) therein, while blocked in said low-price hearing system. A remote control of the hearing system might have a button that is labelled for starting wireless audio streaming to two hearing devices of the hearing system, but this functionality is blocked in the user's low-price hearing system. Accordingly, if the user presses said button, the non-technical rules will be checked, and it will be found, that said wireless audio streaming shall not be carried out, although it would be technically possible and in accordance with all technical rules.

Although devices of a hearing system are, in most cases, portable devices, which belong to the user of the hearing system, it is possible, in a particular embodiment, to consider devices a part of an extended hearing system, which are participating in a short-range communication network together with other devices of the hearing system, but which are not portable or fixedly installed in a location. Devices, however, which are connected to devices of a hearing system via a long-range communication link, shall not be considered a part of the hearing system.

An example of a device that forms a part of the above-mentioned extended hearing system is an accessory, which is (fixedly) installed in a church and can provide a particularly suitable signal processing algorithm that allows for good speech intelligibility in that particular church. When a device of the (unextended) hearing system is within the communication range of the short-range network with said installed accessory, communication is established, and said installed accessory becomes part of said extended hearing system. The functionality providable by said fixedly installed accessory can be offered and made selectable within the hearing system, and if the user requests said particular functionality, it can be executed (possibly upon a payment).

LIST OF REFERENCE SYMBOLS

1 hearing system
11 hearing device
12 hearing device
13 remote control
14 device, accessory
15 communication link
30 user input interface
31 user control
39 user output interface, display
40 decision unit
50 checking unit
60 storage unit A functionality
B functionality
C functionality
D functionality

What is claimed is:

1. A method for operating a hearing system (1) comprising at least one hearing device, said method comprising the steps of a) requesting (300) said hearing system (1) to execute a functionality (A,B,C,D);

b) the at least one hearing device communicating a current availability of the requested functionality (A,B,C,D) in said hearing device; and c) deciding (400), based on the so-obtained current availability of the requested functionality (A,B,C,D) as communicated by the at least one hearing device, whether or not to execute the requested functionality (A,B,C,D), wherein step c) comprises the step of f) obtaining data related to the provision of at least one resource in said hearing system (1);

wherein the decision of step c) depends on whether or not said at least one resource is provided in said hearing system (1).

2. The method according to claim 1, wherein step b) is carried out by said hearing system (1) automatically upon step a).

3. The method according to claim 1, wherein step a) is carried out by operating at least one user control (31) of at least one device (13) of said hearing system (1).

4. The method according to claim 1, comprising the step of d) executing the requested functionality (A,B,C,D), only if the requested functionality (A,B,C,D) is currently available in said hearing system (1).

5. The method according to claim 1, comprising the step of e) executing an alert or error function, if the requested functionality (A,B,C,D) is not currently available in said hearing system (1).

6. The method according to claim 1, wherein step c) comprises the step of g) obtaining data related to the status of said hearing system (1);

wherein the decision of step c) depends on said status.

7. The method according to claim 1, wherein step c) comprises the step of i) transmitting data from at least one device of said hearing system (1) to at least one other device of said hearing system (1).

8. The method according to claim 1, wherein said current availability is independent of the identity of the individual using said hearing system (1).

9. The method according to claim 1, comprising the step of r) repeating step b) during carrying out the requested functionality (A,B,C,D).

10. A method for operating a hearing system (1) comprising at least one hearing device, said method comprising the steps of a) requesting (300) said hearing system (1) to execute a functionality (A,B,C,D);b)

the at least one hearing device communicating a current availability of the requested functionality (A,B,C,D) in said hearing device; and c) deciding (400), based on the so-obtained current availability of the requested functionality (A,B,C,D) as communicated by the at least one hearing device, whether or not to execute the requested functionality (A,B,C,D), wherein step c) comprises the step of h) obtaining data representative of at least one rule related to at least one functionality (A,B,C,D) provided in said hearing system (1);

wherein the decision of step c) depends on compliance with said at least one rule.

11. A hearing system (1), comprising:

at least one decision unit (40) adapted to decide whether or not to execute functionalities (A,B,C,D), that it has been requested to execute, a current availability of the functionalities (A,B,C,D) having been communicated to the decision unit of said hearing system (1) by a hearing device of said hearing system;

at least one checking unit (50) adapted to checking the current availability of a requested functionality (A,B,C,D), wherein the result of said checking is transmittable to said at least one decision unit (40), and wherein the decision of said at least one decision unit (40) is dependent on said result of said checking; and a storage unit operationally connected to said at least one checking unit (50) and comprising data indicative of at least one functionality (A,B,C,D) of said hearing system (1) that is currently executed in said hearing system (1).

12. The hearing system (1) according to claim 11, comprising at least one user control (31), wherein said functionalities (A,B,C,D) are requested by means of said at least one user control (31).

13. The hearing system (1) according to claim 11, comprising a storage unit operationally connected to said at least one checking unit and comprising data indicative of at least one functionality (A,B,C,D) that is provided in at least one device of said hearing system (1).

14. The hearing system (1) according to claim 11, comprising a storage unit (60) operationally connected to said at least one checking unit (50) and comprising data representative of at least one rule related to functionalities (A,B,C,D) available in said hearing system (1), wherein the decision of said decision unit (40) is dependent on compliance with said at least one rule.

15. The hearing system (1) according to claim 11, wherein said data comprised in said storage unit are data transmitted from at least one device (11,12,13,14) of said hearing system (1) to at least one other device (11,12,13,14) of said hearing system (1).

* * * * *